United States Patent [19]

Nobileau

[11] Patent Number: 5,044,442

[45] **Date of Patent: * Sep. 3, 1991**

[54] CASING HANGER RUNNING TOOL USING ANNULUS PRESSURE

[75] Inventor: Philippe C. Nobileau, Paris, France

[73] Assignee: Abb Vetcogray Inc., Houston, Tex.

[ * ] Notice: The portion of the term of this patent subsequent to Feb. 27, 2007 has been disclaimed.

[21] Appl. No.: 472,788

[22] Filed: Jan. 31, 1990

[51] Int. Cl.[5] ..... E21B 33/43; E21B 23/04

[52] U.S. Cl. ..... 166/382; 166/182; 166/348; 166/383; 166/387; 285/18; 285/140

[58] Field of Search ..... 166/387, 181, 182, 382, 166/381, 383, 82, 86, 88, 348, 358, 368, 208, 212, 217; 285/18, 140, 141

[56] References Cited

U.S. PATENT DOCUMENTS 4,790,572 12/1988 Slyker ..... 166/182 X 4,903,776 2/1990 Nobileau et al. ..... 166/382

*Primary Examiner*—William P. Neuder

*Attorney, Agent, or Firm*—James E. Bradley

[57] ABSTRACT

A running tool will set a packoff between a casing hanger and a wellhead housing utilizing weight and hydraulic pressure. The running tool has a mandrel which connects to the drill string. A lower and an upper body are carried by the mandrel. The lower body releasably connects to the casing hanger for supporting the casing hanger as it is lowered into the well. The packoff mounts to the upper body. An elastomeric seal locates on the upper body of the packoff. The upper body will move downward relative to the lower body once the casing has been cemented. In this lower position, weight of the drill string transmits from a collar to the elastomeric seal to form a seal against the wellhead housing. Hydraulic pressure may then be applied. The hydraulic pressure creates a force on the upper body to set the packoff. The running tool along with the elastomeric seal will be retrieved to the surface.

6 Claims, 3 Drawing Sheets

CASING HANGER RUNNING TOOL USING ANNULUS PRESSURE

BACKGROUND OF THE INVENTION

1. Field of the Invention

This invention relates in general to running tools for running a casing hanger to a subsea wellhead housing and for setting a packoff between the casing hanger and the wellhead housing.

2. Description of the Prior Art

One type of subsea well completion utilizes a wellhead housing at the subsea floor. A string of casing will be lowered into the well once the well has been drilled to a certain depth. The casing hanger locates at the upper end of the string of casing and lands on a shoulder in the wellhead housing. Cement will be pumped down the string of casing to cement it in place. Then a packoff will be set between the casing hanger and the wellhead housing to seal the annulus.

There are a number of running tools for setting a packoff. Some use the weight of the casing string to set the packoff. Others use torque to set the packoff. Hydraulic pressure in the annulus is sometimes used to assist in setting the packoff.

In the past, most of the packoffs were metal or a combination of metal and elastomer. Now, metal-to-metal packoffs are used to avoid deterioration of the packoff over a long period of time. Metal-to-metal packoffs, however, require a much greater setting force than the prior elastomer packoffs. Consequently, running tools which will achieve the necessary force to set the packoff are desirable.

SUMMARY OF THE INVENTION

The running tool of this invention has a mandrel which connects to a string of conduit. The mandrel carries a body. The packoff releasably connects to the body. An elastomeric seal will be located on the body above the packoff for sealing against the wellhead housing when the running tool is lowered into the wellhead housing. Means exist for transferring the weight of the string of conduit to the body to apply a downward force on the packoff to initially set the packoff. Then, hydraulic pressure applied to the annulus surrounding the mandrel will cause the body to move downward to finally set the packoff. After setting, the running tool including the elastomeric seal will be retrieved to the surface.

DETAILED DESCRIPTION OF THE INVENTION

Figure 1:
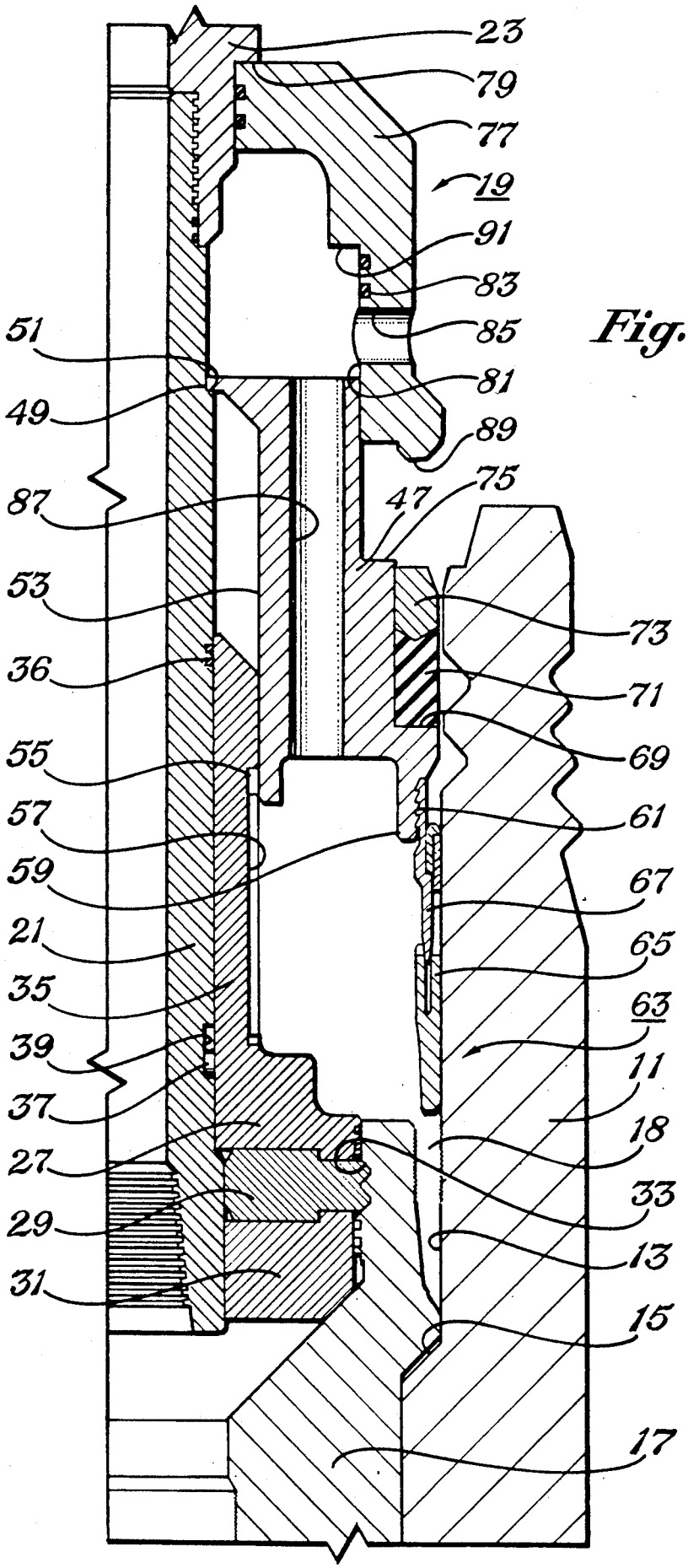
FIG. 1 is a vertical quarter sectional view of a running tool constructed in accordance with this invention, shown with the packoff in an upper position.

Referring to FIG. 1, the subsea well will have a wellhead housing 11 located at the sea floor. Wellhead housing 11 is a large tubular member having a bore 13. An upward facing shoulder 15 will be located in the bore. A casing hanger 17 will be secured to the upper end of a string of casing (not shown). The casing hanger 17 lands on the shoulder 15 to support the string of casing. An annular clearance 18 exists between the wellhead housing bore 13 and exterior wall of the casing hanger 17 above the shoulder 15.

Figure 2:
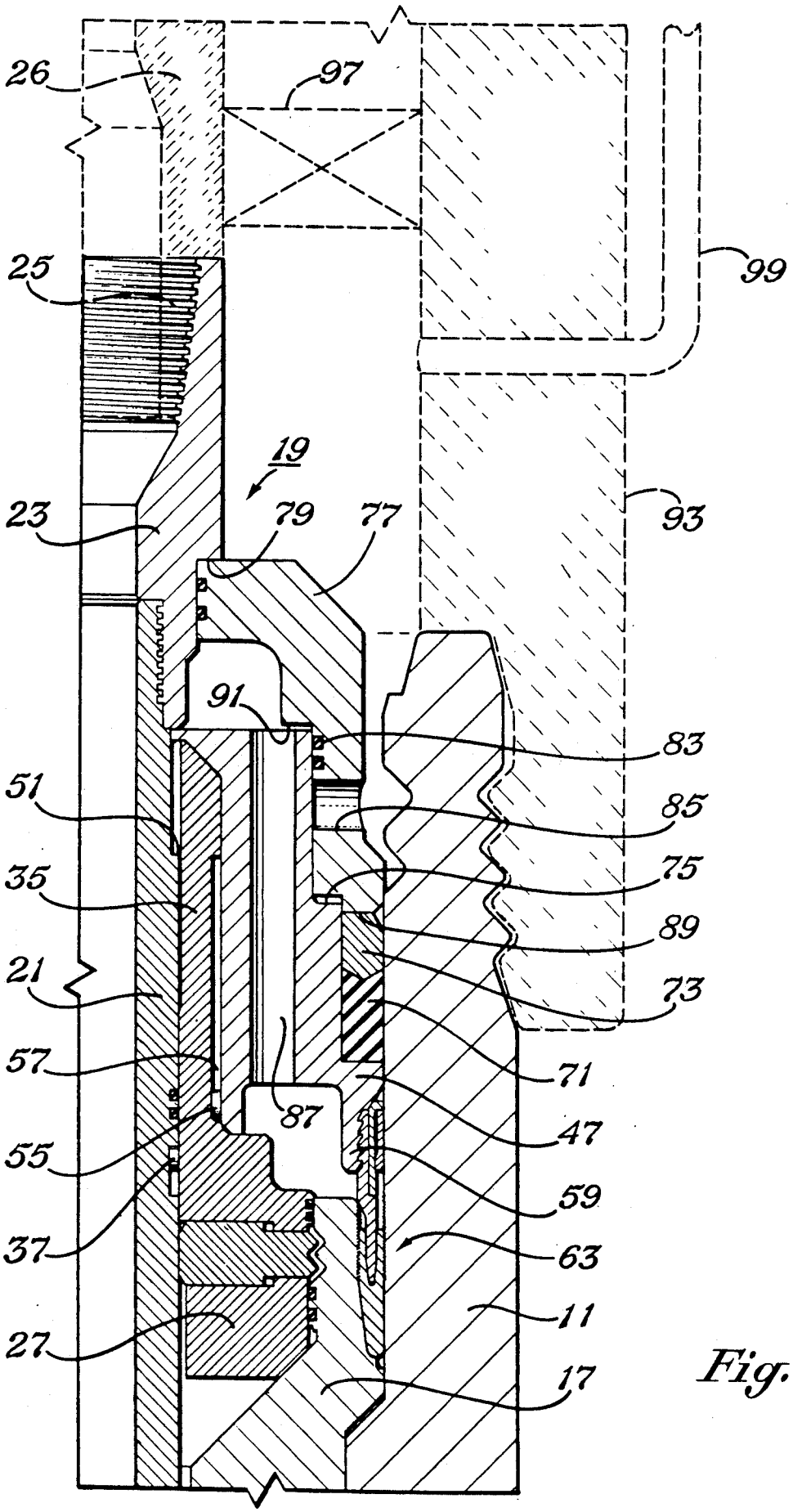
FIG. 2 is a quarter sectional view of the running tool of FIG. 1, showing the packoff in a set position.

A running tool 19 supports the casing hanger 17 and the string of casing as it is lowered into the well. Running tool 19 has a tubular axial mandrel 21. Mandrel 21 extends the length of the running tool 19 and has an adapter 23 on its upper end. As shown in FIG. 2, threads 25 in the adapter 23 serve as means for connecting the mandrel 21 to a string of conduit 26, schematically shown. The string of conduit 26, normally drill pipe, will be lowered from a drilling vessel (not shown) at the surface of the sea.

A lower body 27 mounts to the lower end of the mandrel 21. Lower body 27 is a tubular member that will slide on the exterior of the mandrel 21. The lower portion of the lower body 27 protrudes radially outward and carries a plurality of dogs 29. The dogs 29 locate in holes in the lower body 27. An enlarged area 31 on the lower end of the mandrel 21 will push the dogs 29 radially outward to engage grooves 33 located in the interior of the casing hanger 17.

FIG. 1 shows the dogs 29 in an outward position, locking the lower body 27 to the casing hanger 17. The lower body 27 has an upward protruding neck 35 of lesser diameter than the lower portion of the lower body 27. Neck 35 sealingly engages the exterior of the mandrel 21 by means of seals 36.

Figure 3:
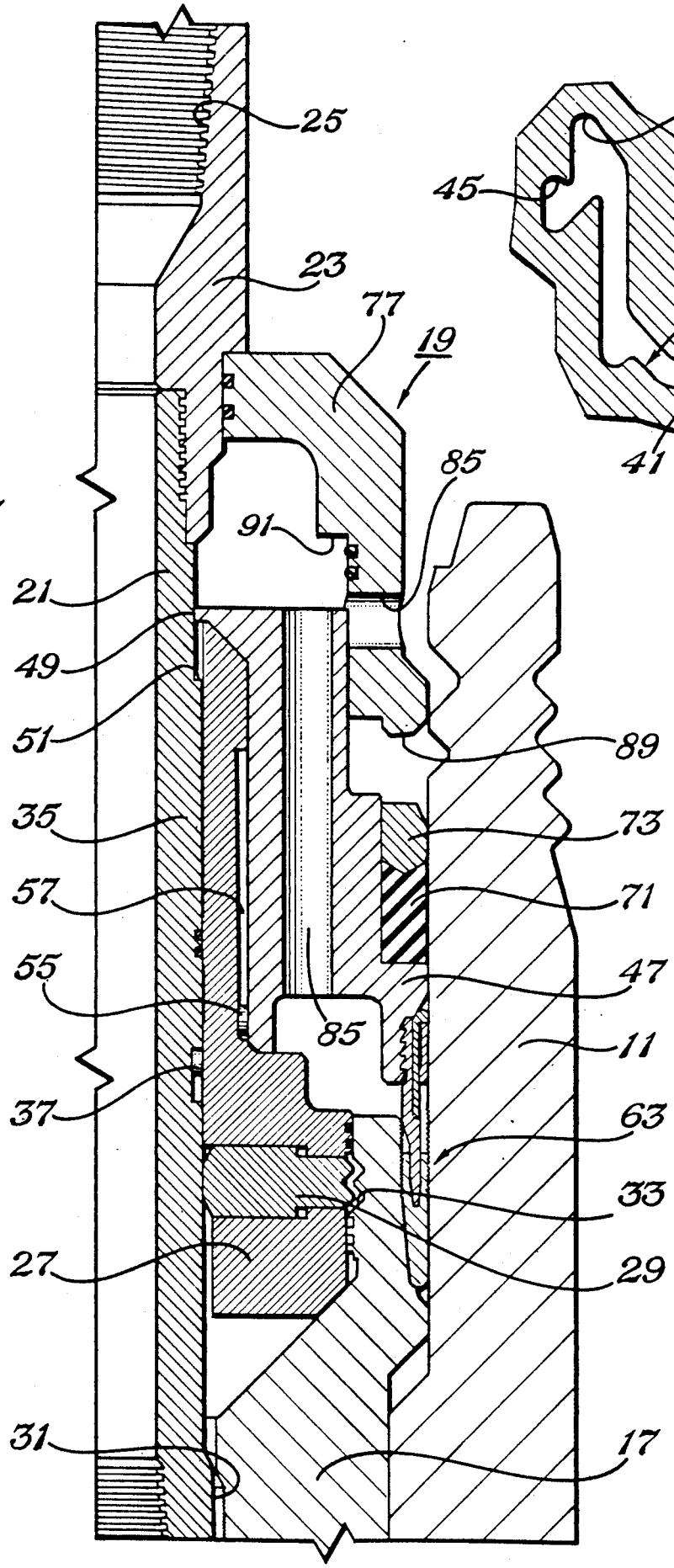
FIG. 3 is a quarter sectional view of the running tool of FIG. 1, showing the packoff in a set position and showing the running tool being picked up to be retrieved to the surface.
Figure 4:
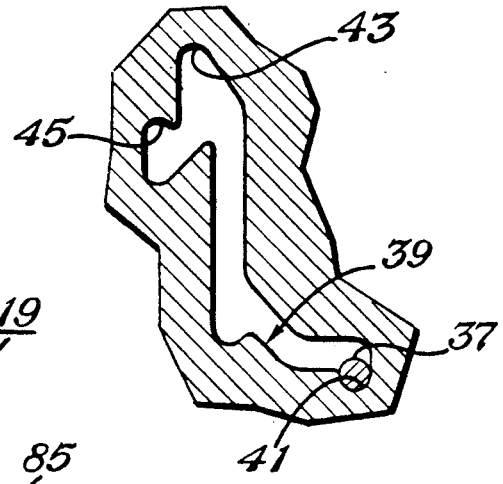
FIG. 4 is a diagram illustrating a J slot utilized with the running tool of FIG. 1.

A pin 37 protrudes radially inward from the bore of the lower body 27. Pin 37 engages a J-slot 39 formed in the exterior of the mandrel 21. Pin 37 and J-slot 39 will support the mandrel 21 in three different positions relative to the lower body 27. As illustrated in FIG. 4, J-slot 39 has a first position 41 for receiving pin 37. In this position, which is shown in FIG. 1, the mandrel 21 will be in an upper position relative to the lower body 27. Rotating the mandrel 21 relative to the lower body 27 allows the mandrel 21 to drop downward to a lower position. In this lower position, the pin 37 will be located in the second position 43. This is the setting position and is shown in FIG. 2. Rotating the mandrel 21 again and picking up the mandrel 21 causes the pin 37 to move to the third position 45. In that position, which is the release position shown in FIG. 3, the mandrel 21 is slightly higher relative to the lower body 27.

Mandrel 21 also carries an upper body 47. Upper body 47 is a tubular member that will move independently of the lower body 27. Upper body 47 has a flange 49 that extends inward and slides on the exterior of mandrel 21. When the mandrel 21 is in an upper position, as shown in FIG. 1, an upward facing shoulder 51 will contact the flange 49 to maintain the upper body 47 in an upper position relative to the lower body 27.

Upper body 47 has an inner wall 53 that is spaced radially outward from the exterior of the mandrel 21. The lower body neck 35 has an outer surface that slidingly engages the inner wall 53. A pin 55 extends inward from the lower portion of the upper body inner wall 53. Pin 55 engages a vertical slot 57 formed in the exterior of the neck 35. The engagement of the pin 55 in the slot 57 prevents the upper body 47 from rotating relative to the lower body 27.

The upper body 47 has a depending sleeve 59 on its lower end. Sleeve 59 has grooves 61 for releasably carrying a packoff assembly 63. Packoff assembly 63 may be of a conventional design. Preferably, it is a solid metal member, having no elastomeric materials. It preferably has a pair of legs 65 which will wedge apart to form a seal. A wedge 67 will be moved downward by the sleeve 59 to wedge the legs 65 apart.

Upper body 47 has an upward facing shoulder 69 on its exterior. A large annular elastomeric seal 71 locates on the shoulder 69. Seal 71 is adapted to seal against the bore 13 of the wellhead housing 11. A metal compression ring 73 will be located on top of the seal 71. The upper end of ring 73 is substantially flush with another shoulder 75 formed on the upper body 47.

A collar 77 mounts to the adapter 23 of the mandrel 21. A shoulder 79 faces downward to transmit downward force on the adapter 23 through the collar 77. Collar 77 extends radially outward from the mandrel 21. An inner wall 81 of the collar 77 will slidingly engage the exterior of the upper body 47 above the shoulder 75. Seals 83 seal the collar 77 to the upper body 47.

Collar 77 has a plurality of radial passages 85. Passages 85 are positioned so that when the collar 77 is in an upper position relative to the upper body 47, the passages 85 will be open. In this position, which is shown in FIG. 1, the passages 85 will communicate with vertical passages 87 extending through the upper body 47. When the collar 77 is in its lower position shown in FIG. 2, the passages 85 will be blocked by the exterior of the upper body 47 above the shoulder 75.

Collar 77 has a downward extending lip 89 on its exterior. The lip 89 will contact and press downward on the compression ring 73 when the collar 77 is in its lowermost position shown in FIG. 2. Collar 77 also has a downward facing shoulder 91 that engages the upper end of the upper body 47 when the collar 77 is the lower position shown in FIG. 2.

In operation, the casing hanger 17 will be secured to a string of casing The running tool 19 will be assembled as shown in FIG. 1. The dogs 29 will engage the grooves 33. A drill string 26 (FIG. 2) will be connected to the threads 25 of the mandrel 21. The entire assembly will be lowered into the well. A string of riser 93, shown schematically in FIG. 2, will connect the wellhead housing 11 with a drilling vessel.

The casing hanger 17 will land on the shoulder 15. The upper body 47 will remain in an upper position relative to the lower body 27. The collar 77 will also remain in an upper position relative to the upper body 47. Cement will be pumped down the drill string 26, through the passage in the mandrel 21 and down through the casing. Returns will flow up the annulus surrounding the casing. The returns will flow past flutes (not shown) provided on the exterior of the casing hanger 17. The returns flow past the packoff 63 and to the surface.

Once the cement has set, the packoff 63 may be set in place. This is handled by a fractional rotation of the drill string 26 and the mandrel 21. The lower body 27 will not rotate because of the engagement of the dogs 29 with the casing hanger 17. The upper body 47 will not rotate because its pin 55 engages vertical slot 57. Rotation of the mandrel 21 causes the J-slot 39 (FIG. 2) to move relative to the pin 37. A slight amount of rotation will place the pin 37 in a vertical portion of the J-slot 39, allowing it to locate in the second position 43.

The mandrel 21 will drop to a lowermost position, as shown in FIG. 2. Upper body 47 will also drop downward. The packoff 63 will enter the clearance 18. The collar 77 will also move downward. The shoulder 91 of the collar 77 will contact the upper end of the upper body 47. The lip 89 will contact the compression ring 73. Weight from the drill string will transmit a force through the adapter 23 and shoulder 79 to the collar 77. This weight will be transmitted to the upper body 47.

The upper body 47 transmits a force downward on the wedge member 67, causing the legs 65 to wedge apart. One of the legs 65 will contact the exterior of the casing hanger 17, and the other will contact the bore 13. This causes an initial setting of the packoff 63, but it will not be set to its final desired force. The weight of the drill string 26 also pushes downward on the compression ring 73 through the lip 89. This deforms the elastomeric seal 71 outward to seal against the bore 13 of the wellhead housing 11. In this position, the passage 85 will be closed.

Pipe rams 97, shown schematically in FIG. 2, will then be closed around the drill string 26. The pipe rams 97 are located within a pressure control section in the string of riser 93 a short distance above the wellhead housing 11. The pipe rams 97 seal between the interior of the riser string 93 and the drill string 26. This closes the annulus surrounding the drill string 26 and surrounding the mandrel 21.

Choke and kill lines 99 extend from below the pipe rams 97, as shown in FIG. 2, to the surface vessel. Hydraulic fluid will be pumped under pressure through the choke and kill lines 99 to this closed annulus below the pipe rams 97. The pressure will act on the elastomeric seal 71 and on the collar 77. The closed passage 85 and the seals 83 prevent any of the fluid pressure from directly communicating with the packoff 63 or lower body 27. This pressure thus creates a downward force on the collar 77 and on the upper body 47. This downward force acts on the wedge member 67 to further wedge the legs 65 apart to the final set position.

After the packoff 63 has been finally set and tested, the running tool 19 may be retrieved to the surface. This is handled by a fractional rotation of the drill string 26. This places the pin 37 in the third position 45 of J-slot 39. The drill string 26 will be lifted, and along with it the mandrel 21. The dogs 29 will be free to retract because their inner ends will be no longer in engagement with the enlarged area 31. The collar 77 will move upward a short distance to open the passage 85 and equalize pressure from above the seal 71 to the area below. A sufficient upward pull will cause the grooves 61 to detach from the upper end of the packoff assembly 63. The running tool 19 will then be retrieved to the surface, leaving only the casing hanger 17 and the packoff assembly 63 downhole. The elastomeric seal 71 will be retrieved along with the running tool 19.

The invention has significant advantages. The elastomeric seal allows an initial seal to be formed in the annulus of the wellhead housing. This initial seal enables hydraulic pressure to be applied to set the packoff. This enables a packoff requiring a high setting force to be set whereas with prior art running tools using torque and weight only, sufficient force might not be available. The elastomeric seal seals the metal packoff from the hydraulic fluid pressure used to set the metal packoff, which might otherwise cause leakage past the metal packoff before the metal packoff reaches its final position.

While the invention has been shown in only one of its forms, it should be apparent to those skilled in the art that it is not so limited, but is susceptible to various changes without departing from the scope of the invention.

I claim:

1. A running tool for setting a packoff between a casing hanger and a wellhead housing, comprising in combination:

a mandrel having means for connection to a string of conduit;

a body carried by said mandrel;

means for releasably connecting the packoff to the body;

an elastomeric seal mounted on the body above the packoff for sealing engagement with the wellhead housing;

means for transmitting weight of the string of conduit to the body to apply a downward force on the packoff once the packoff is located between the casing hanger and wellhead housing to initially set the packoff; and means for applying hydraulic pressure to the interior of the wellhead housing above the elastomeric seal to cause the body to exert a downward force on the packoff to finally set the packoff; and means for retrieving the running tool along with the elastomeric seal once the packoff has set.

2. A running tool for setting a packoff between a casing hanger and a wellhead housing, comprising in combination:

a mandrel having means for connection to a string of conduit;

a lower body carried by said mandrel;

means for releasably connecting the lower body to the casing hanger for lowering the casing hanger into the wellhead housing on the string of conduit;

an upper body carried by the mandrel;

means for releasably connecting the packoff to the upper body;

an elastomeric seal mounted on the upper body above the packoff;

means for moving the upper body downward relative to the lower body from an upper position wherein the packoff is spaced above the casing hanger to a lower position with the packoff located between the casing hanger and wellhead housing and with the elastomeric seal located in sealing engagement with the wellhead housing;

means for applying hydraulic pressure to the elastomeric seal to force the upper body and elastomeric seal downward to set the packoff; and means for retrieving the running tool along with the elastomeric seal once the packoff has set.

3. A running tool for setting a packoff between a casing hanger and a wellhead housing, comprising in combination:

a mandrel having means for connection to a string of conduit;

a lower body carried by said mandrel;

means for releasably connecting the lower body to the casing hanger for lowering the casing hanger into the wellhead housing on the string of conduit;

an upper body carried by the mandrel;

means for releasably connecting the packoff to the upper body;

an elastomeric seal mounted on the upper body above the packoff;

means for moving the mandrel and upper body downward relative to the lower body from an upper position wherein the packoff is spaced above the casing hanger to a lower position with the packoff located between the casing hanger and wellhead housing and with the elastomeric seal located in sealing engagement with the wellhead housing;

means for transmitting weight of the string of conduit to the upper body to apply a downward force on the packoff once the upper body is in the lower position;

means for sealing the upper body to the mandrel to allow hydraulic pressure to be applied to the upper body and elastomeric seal when the upper body is in the lower position for forcing the upper body and elastomeric seal downward to set the packoff; and means for retrieving the running tool along with the elastomeric seal and for allowing the packoff and casing hanger to remain in the wellhead housing.

4. A running tool for setting a packoff between a casing hanger and a wellhead housing, comprising in combination:

a mandrel having means for connection to a string of conduit;

a lower body carried by said mandrel;

means for releasably connecting the lower body to the casing hanger for lowering the casing hanger into the wellhead housing on the string of conduit;

an upper body carried by the mandrel and having an upward facing shoulder;

means for releasably connecting the packoff to the upper body below the shoulder;

an elastomeric seal carried on the upper body on the shoulder;

a ring carried by the upper body in contact with an upper end of the elastomeric seal, the ring being axially movable relative to the upper body;

a collar mounted to the mandrel for downward movement with the mandrel and having a lower side positioned to contact the ring;

means for moving the mandrel, collar and upper body downward relative to the lower body from an upper position wherein the packoff is spaced above the casing hanger to a lower position with the packoff located between the casing hanger and wellhead housing and with the elastomeric seal located in sealing engagement with the wellhead housing;

means for transmitting weight of the string of conduit from the mandrel to the upper body and to the packoff to begin setting the packoff and for causing the collar to apply a downward force on the ring to compress the elastomeric seal between the upper body and wellhead housing once the upper body is in the lower position;

means for applying hydraulic pressure to the elastomeric seal when the upper body is in the lower position for forcing the upper body and elastomeric seal downward to set the packoff; and means for retrieving the running tool along with the elastomeric seal and for allowing the packoff and casing hanger to remain in the wellhead housing.

5. A method for setting a packoff between a casing hanger and a wellhead housing, comprising in combination:

providing a running tool with a mandrel and a body;

releasably mounting the packoff to the body;

mounting an elastomeric seal to the body above the packoff;

securing the mandrel to the string of conduit and lowering the body into the wellhead housing with the packoff located in a position between the casing hanger and wellhead housing and the elastomeric seal in a position sealed against the wellhead housing;

applying hydraulic pressure to the interior of the wellhead housing above the elastomeric seal to force the body and elastomeric seal downward relative to the packoff to provide a force to set the packoff; and retrieving the mandrel, body and elastomeric seal once the packoff has set.

6. A method for setting a packoff between a casing hanger and a wellhead housing, comprising in combination:

providing a running tool with a mandrel, an upper body and a lower body;

releasably mounting the packoff to the upper body;

mounting an elastomeric seal to the upper body above the packoff;

releasably securing the lower body to the casing hanger, and securing the casing hanger to a string of casing;

securing the mandrel to a string of conduit and lowering the casing hanger into the wellhead housing;

cementing the casing;

lowering the string of conduit, mandrel and upper body to place the packoff in a position between the casing hanger and wellhead housing and the elastomeric seal in a position sealed against the wellhead housing;

applying weight from the string of conduit to the upper body to apply an initial setting force to the packoff; then applying hydraulic pressure to the interior of the wellhead housing above the elastomeric seal to force the upper body and elastomeric seal downward relative to the packoff to provide a final force to set the packoff; and retrieving the mandrel, upper and lower bodies and elastomeric seal once the packoff has set.

* * * * *